US011408323B2

(12) United States Patent
Choi et al.

(10) Patent No.: US 11,408,323 B2
(45) Date of Patent: Aug. 9, 2022

(54) EXHAUST MANIFOLD HEAT DISSIPATION COVER COUPLING DEVICE FOR THERMAL STRESS AND VIBRATION DEFLECTION

(71) Applicants: Hyundai Motor Company, Seoul (KR); Kia Motors Corporation, Seoul (KR); Hantec Technology Co., Ltd., Ulsan (KR)

(72) Inventors: Sung Joon Choi, Busan (KR); Jae Gi Sim, Seoul (KR); Seung Hoon Lee, Gyeonggi-Do (KR); Jung Hyeok Lim, Gyeonggi-Do (KR); Yong Pyo Hong, Jeollabuk-do (KR); Seong Bin Moon, Gyeonggi-Do (KR)

(73) Assignees: Hyundai Motor Company, Seoul (KR); Kia Motors Corporation, Seoul (KR); Hantec Technology Co., Ltd., Ulsan (KR)

( * ) Notice: Subject to any disclaimer, the term of this patent is extended or adjusted under 35 U.S.C. 154(b) by 0 days.

(21) Appl. No.: 17/167,472

(22) Filed: Feb. 4, 2021

(65) Prior Publication Data

US 2021/0246821 A1 Aug. 12, 2021

(30) Foreign Application Priority Data

Feb. 6, 2020 (KR) ..... 10-2020-0014272

(51) Int. Cl.
*F01N 13/10* (2010.01)
*F01N 13/14* (2010.01)
*F01N 13/18* (2010.01)

(52) U.S. Cl.
CPC ..... *F01N 13/102* (2013.01); *F01N 13/14* (2013.01); *F01N 13/1811* (2013.01);
(Continued)

(58) Field of Classification Search
CPC .... F01N 13/102; F01N 13/14; F01N 13/1811; F01N 13/1855; F01N 2260/10; F01N 2260/20; F01N 2310/04; F01N 2450/24
See application file for complete search history.

(56) References Cited

U.S. PATENT DOCUMENTS 4,921,203 A * 5/1990 Peterson ..... F16F 3/0873 248/635
6,328,513 B1 * 12/2001 Niwa ..... F16F 1/362 16/2.1

(Continued)

FOREIGN PATENT DOCUMENTS

JP 2000274415 A 10/2000
JP 2010-156372 A 7/2010

(Continued)

OTHER PUBLICATIONS

Extended European Search Report for Application No. EP 21155441.5, dated Jun. 14, 2021, 8 pages.

*Primary Examiner* — Audrey B. Walter
(74) *Attorney, Agent, or Firm* — Fox Rothschild LLP

(57) ABSTRACT

An exhaust manifold heat dissipation cover coupling device for thermal stress and vibration deflection is proposed. The device has a function of preventing wear of a heat dissipation cover to couple an exhaust manifold heat dissipation cover, the device being able to improve the durability of various parts including a heat dissipation cover by attenuating multi-directional vibration that is transmitted from an exhaust manifold when the heat dissipation cover is installed outside the exhaust manifold, being able to prevent damage to parts due to thermal stress by flexibly coping with thermal deformation such as thermal contraction or thermal expansion even if the thermal deformation is generated by high-temperature heat transmitted from the exhaust manifold, and being able to prevent frictional damage of the heat dissipa- (Continued)

tion cover due to friction by a component that slides to attenuate vibration.

5 Claims, 11 Drawing Sheets

(52) U.S. Cl.
CPC ..... *F01N 13/1855* (2013.01); *F01N 2260/10* (2013.01); *F01N 2260/20* (2013.01); *F01N 2310/04* (2013.01); *F01N 2450/24* (2013.01)

(56) References Cited

U.S. PATENT DOCUMENTS

| | | | | |
|---|---|---|---|---|
| 6,561,312 | B2 * | 5/2003 | Stanienda | F16B 5/0241 180/300 |
| 8,899,376 | B2 * | 12/2014 | Akimoto | F16F 1/06 181/209 |
| 2005/0028963 | A1 * | 2/2005 | Niwa | F01N 13/1805 165/5 |
| 2005/0139416 | A1 * | 6/2005 | Niwa | B60R 13/0876 181/207 |
| 2005/0140075 | A1 * | 6/2005 | Mishima | F02B 77/11 267/140.11 |
| 2020/0003273 | A1 * | 1/2020 | Kato | F01N 13/102 |

FOREIGN PATENT DOCUMENTS

| | | | | |
|---|---|---|---|---|
| JP | 2010156372 | A | * | 7/2010 |
| KR | 10-0999631 | | | 12/2010 |
| KR | 20150071487 | A | | 6/2015 |
| KR | 10-1579895 | | | 12/2015 |

* cited by examiner

EXHAUST MANIFOLD HEAT DISSIPATION COVER COUPLING DEVICE FOR THERMAL STRESS AND VIBRATION DEFLECTION

CROSS REFERENCE TO RELATED APPLICATION

The present application claims priority to Korean Patent Application No. 10-2020-0014272, filed on Feb. 6, 2020, the entire contents of which is incorporated herein for all purposes by this reference.

BACKGROUND OF THE INVENTION

Field of the Invention

The present invention relates to an exhaust manifold heat dissipation cover coupling device for thermal stress and vibration deflection. In more detail, the present invention relates to a device having a function of preventing wear of a heat dissipation cover to couple an exhaust manifold heat dissipation cover, the device being able to improve the durability of various parts including a heat dissipation cover by attenuating multi-directional vibration that is transmitted from an exhaust manifold when the heat dissipation cover is installed outside the exhaust manifold, being able to prevent damage to parts due to thermal stress by flexibly coping with thermal deformation such as thermal contraction or thermal expansion even if the thermal deformation is generated by high-temperature heat transmitted from the exhaust manifold, and being able to prevent frictional damage of the heat dissipation cover due to friction by a component that slides to attenuate vibration.

Description of the Related Art

Exhaust gas that is produced after combustion of fuel in cylinders of an engine is collected into an exhaust manifold and the discharged outside through an exhaust pipe.

In general, exhaust gas flowing through an exhaust manifold is at a considerably high temperature and the surface temperature of the exhaust manifold is at high temperature of over about 600 □ or higher due to the exhaust gas.

Heat is transmitted to other engine parts around the exhaust manifold due to high temperature of the exhaust manifold, and accordingly, the possibility of thermal damage such as cracks generated in other parts around the exhaust manifold due to thermal expansion and thermal contraction by thermal stress is increased.

In order to prevent such thermal damage, a heat protector or a heat dissipation cover for blocking heat that is transmitted form an exhaust manifold is usually installed outside the exhaust manifold.

A heat dissipation cover is coupled to an exhaust manifold by fasteners such as bolts, and vibration generated by an engine is transmitted to the exhaust manifold, so the exhaust manifold vibrates in various directions. Accordingly, as load and shock are repeatedly applied to the fasteners coupling the exhaust manifold and the heat dissipation cover, there is a high possibility that the fasteners coupling the exhaust manifold and the heat dissipation cover are loosened or fatigue fracture of the fasteners is generated by fatigue load.

Further, there is a problem that heat generated by the exhaust manifold is transmitted to the heat dissipation cover and other parts included in the heat dissipation cover through the fasteners such as bolts fixing the heat dissipation cover, whereby thermal damage such as cracks due to thermal stress may be generated in the heat dissipation cover and other parts.

Friction is continuously generated between a heat dissipation cover and a component that slides left and right in direct contact with the heat dissipation cover to attenuate vibration of the exhaust manifold, whereby the heat dissipation cover having relatively low strength may be worn and correspondingly broken.

Accordingly, there is a need for a new mean that can stably fix a heat dissipation cover and an exhaust manifold and can prevent wear and damage due to friction of the heat dissipation cover by a component sliding to attenuate vibration in order to reduce vibration and heat generated by the exhaust manifold and flexibly cope with thermal deformation due to thermal stress.

SUMMARY OF THE INVENTION

The present invention has been made in an effort to solve the problems and an objective of the present invention is to provide a device having a function of preventing wear of a heat dissipation cover to couple an exhaust manifold heat dissipation cover, the device being able to improve the durability of various parts including a heat dissipation cover by attenuating multi-directional vibration that is transmitted from an exhaust manifold when the heat dissipation cover is installed outside the exhaust manifold, being able to prevent damage to parts due to thermal stress by flexibly coping with thermal deformation such as thermal contraction or thermal expansion even if the thermal deformation is generated by high-temperature heat transmitted from the exhaust manifold, and being able to prevent frictional damage of the heat dissipation cover due to friction by a component that slides to attenuate vibration.

In order to achieve the objective of the present invention, an exhaust manifold heat dissipation cover coupling device for thermal stress and vibration deflection according to the present invention includes: an inner bush having a through-center portion and coupled to a lower portion of a coupling hole formed at a heat dissipation cover; an outer bush having a through-center portion and coupled to an upper portion of a coupling hole formed at the heat dissipation cover; an inner mesh elastic body having a through-center portion and disposed under the inner bush; an outer mesh elastic body having a through-center portion and disposed over the outer bush; an inner collar having a through-center portion and disposed under inner mesh elastic body; and an outer collar having a through-center portion and disposed over the outer mesh elastic body, in which the inner bush has a bush protrusion protruding upward and formed by the through-center portion and the outer bush is formed in a hollow disc shape; and the inner mesh elastic body and the outer mesh elastic body are made of the same material as the inner bush and the outer bush, the inner mesh elastic body and the outer mesh elastic body attenuate vibration and prevent wear of the heat dissipation cover by independently sliding only on contact surfaces of the inner bush and the outer bush, respectively.

The inner bush and the outer bush may be first coupled and fixed to the coupling hole of the heat dissipation cover and then, the inner mesh elastic body, the outer mesh elastic body, the inner collar, and the outer collar may be coupled.

The outer bush is thinner than the inner bush to prevent a step due to the thickness difference between the inner bush and the outer bush when the bush protrusion of the inner bush is bent to press the outer bush such that the outer bush and the inner bush are coupled to the coupling hole of the heat dissipation cover.

According to the present invention, it is possible to improve the durability of parts including a heat dissipation cover by reducing thermal stress and vibration that are transmitted to the heat dissipation cover.

Further, since the configuration is simple, installation and maintenance are easy and the number of parts is reduced, so the manufacturing cost can be decreased.

Further, it is possible to prevent wear of the heat dissipation cover using a component that attenuates vibration.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
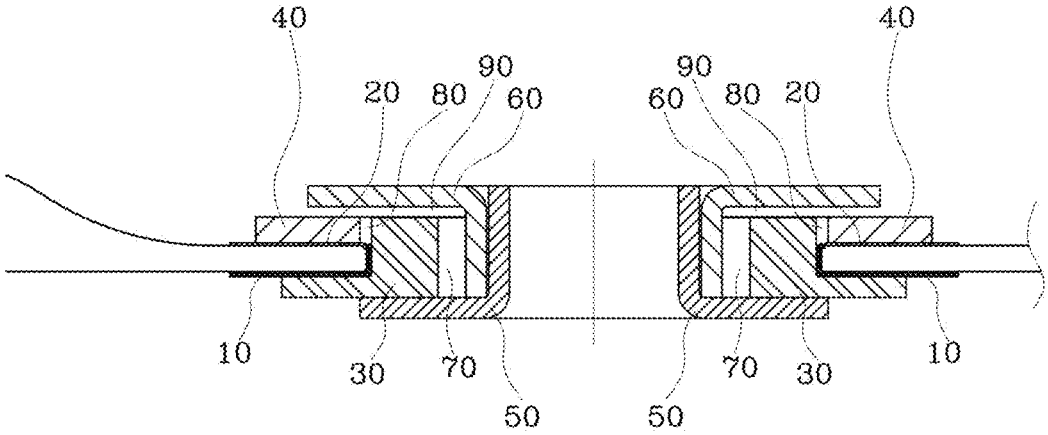
FIG. 1 is a view showing a cross-section when components of an exhaust manifold heat dissipation cover coupling device for thermal stress and vibration deflection according to an embodiment of the present invention have been assembled.

Hereinafter, exemplary embodiments of the present invention are described in detail with reference to the accompanying drawings. It should be noted that when components are given reference numerals in drawings, same components are given the same reference numerals even if they are shown in different drawings. In describing the present invention, well-known functions or constructions will not be described in detail since they may unnecessarily obscure the understanding of the present invention. Further, it should be noted that although embodiments of the present invention will be described below, the spirit of the present invention is not limited thereto and may be achieved in various ways by those skilled in the art.

Figure 2:
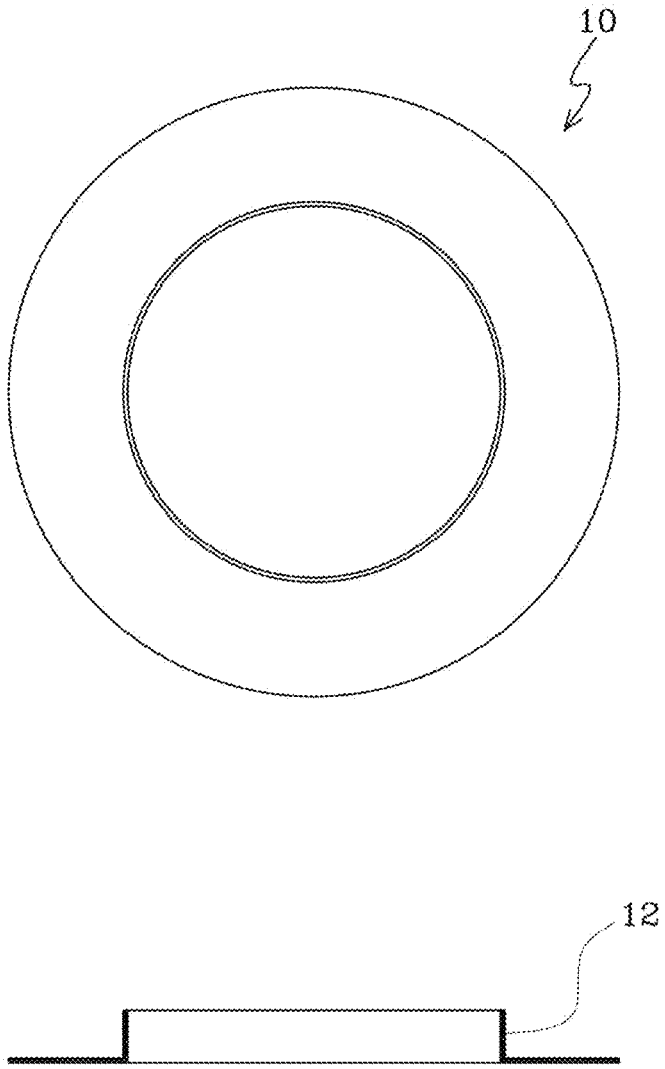
FIG. 2 is a view showing an inner bush.
Figure 3:
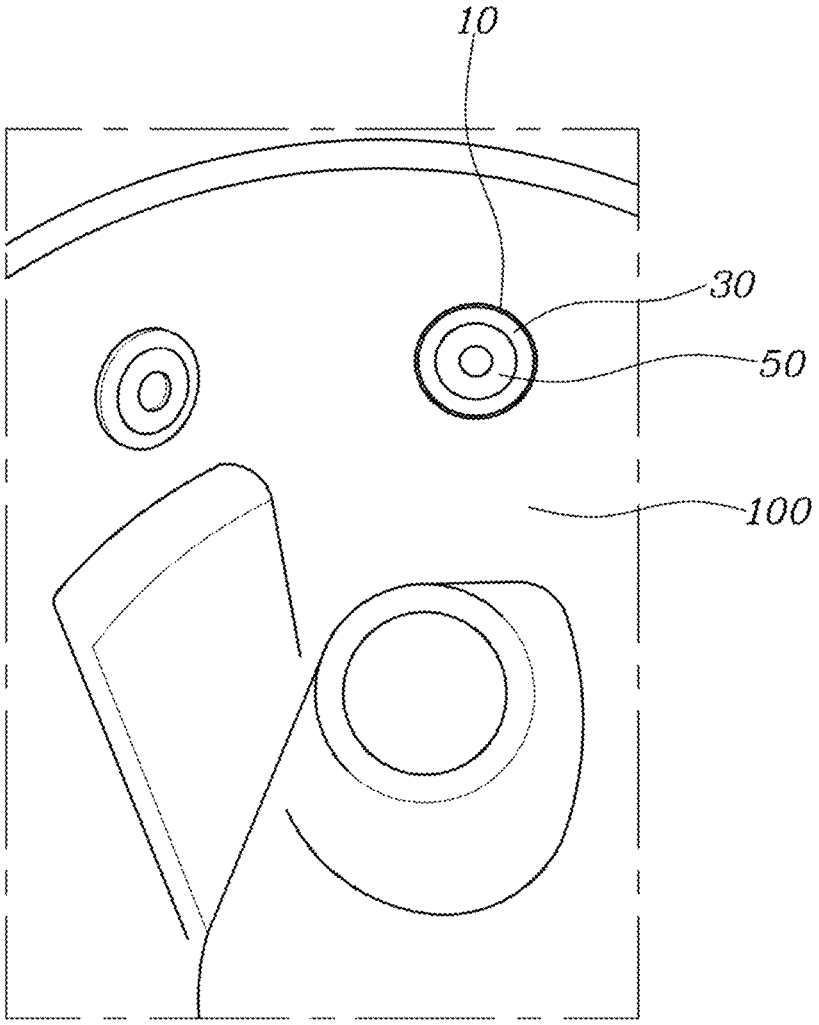
FIG. 3 is a view showing the state in which the inner bush is fitted in an outside coupling hole of a heat dissipation cover.
Figure 4:
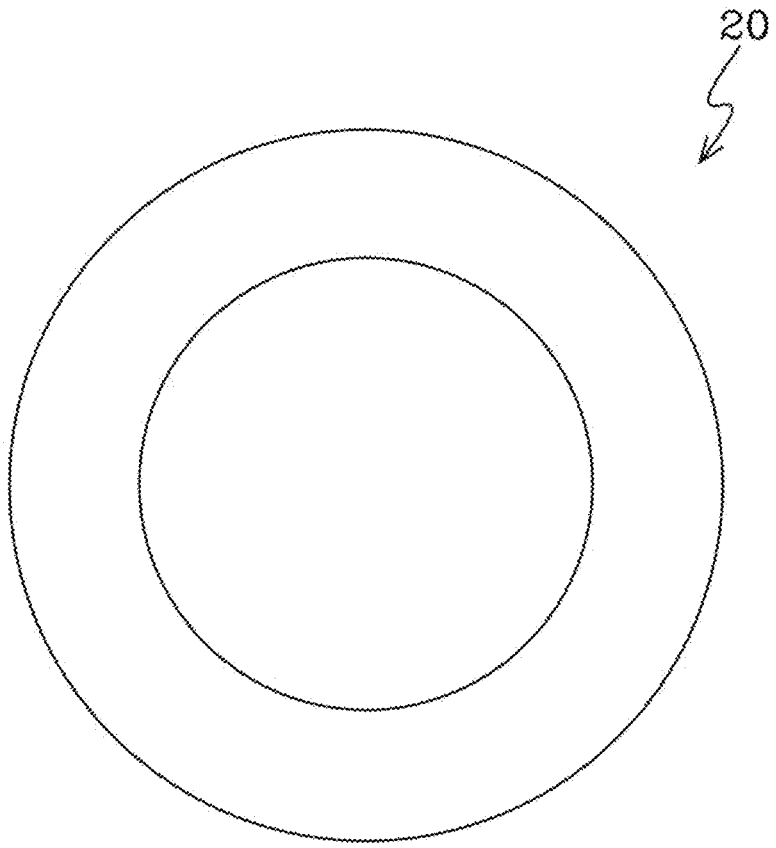
FIG. 4 is a view showing an outer bush.
Figure 5:
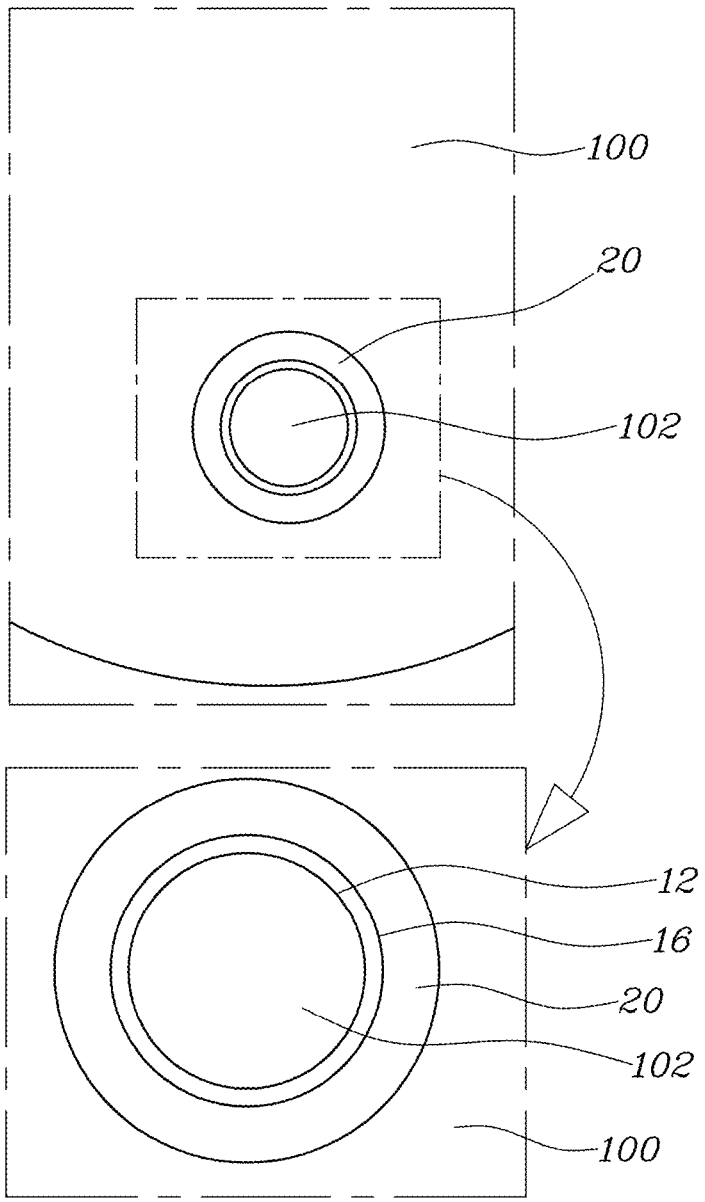
FIG. 5 is a view showing the state in which the outer bush is fitted an inside coupling hole of the heat dissipation cover.
Figure 6:
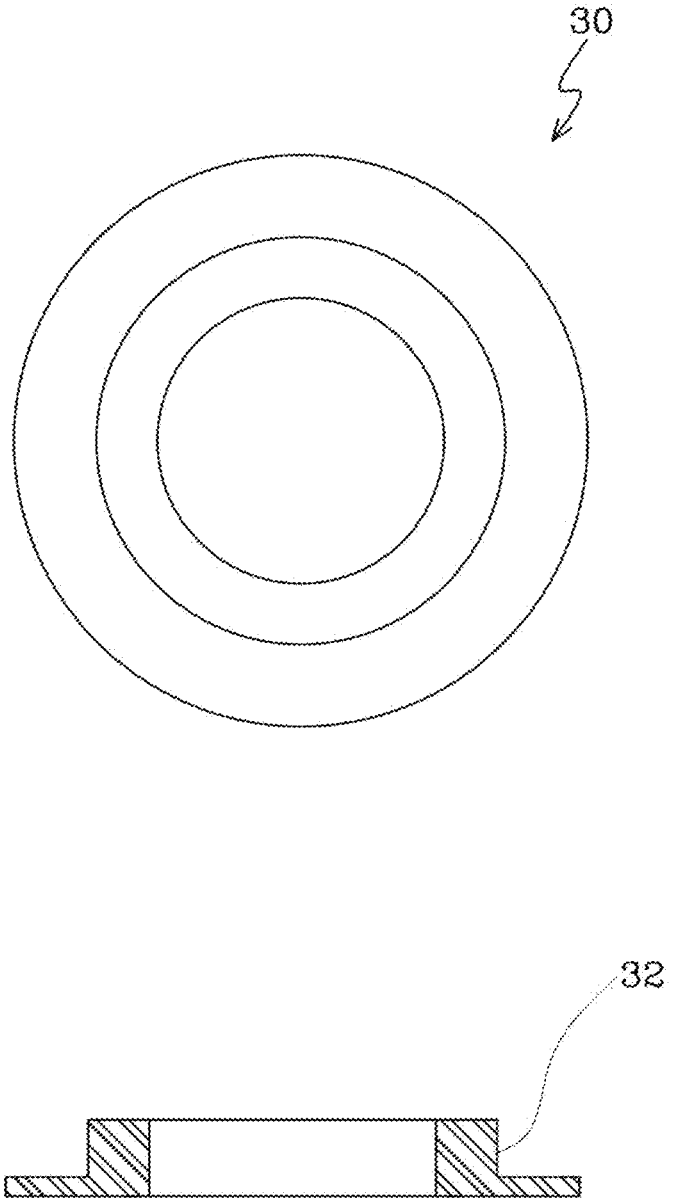
FIG. 6 is a view showing an inner mesh elastic body.
Figure 7:
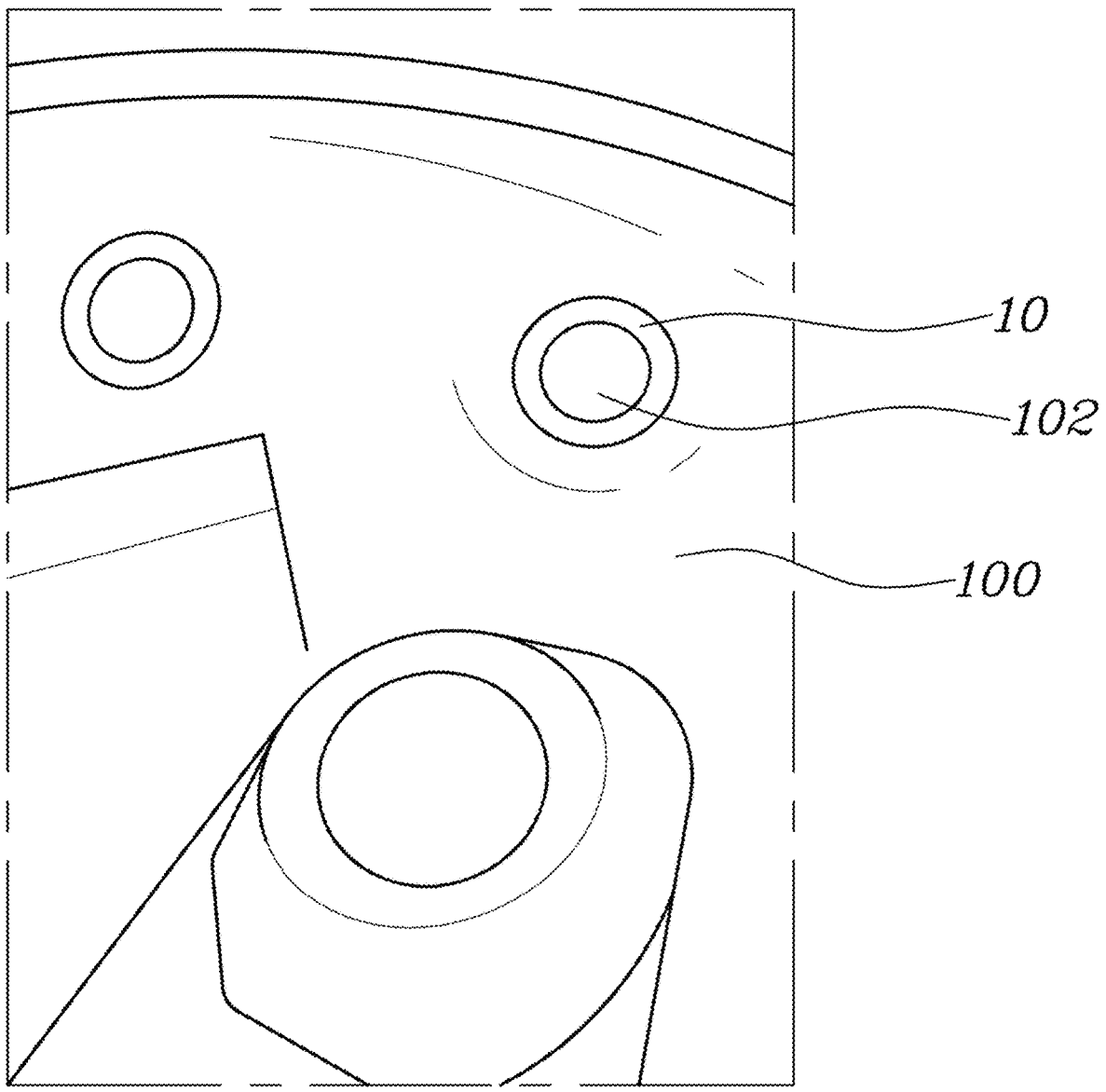
FIG. 7 is a view showing the state in which an inner bush, an inner mesh elastic body, and an inner collar are coupled to the inner side of the heat dissipation cover.
Figure 8:
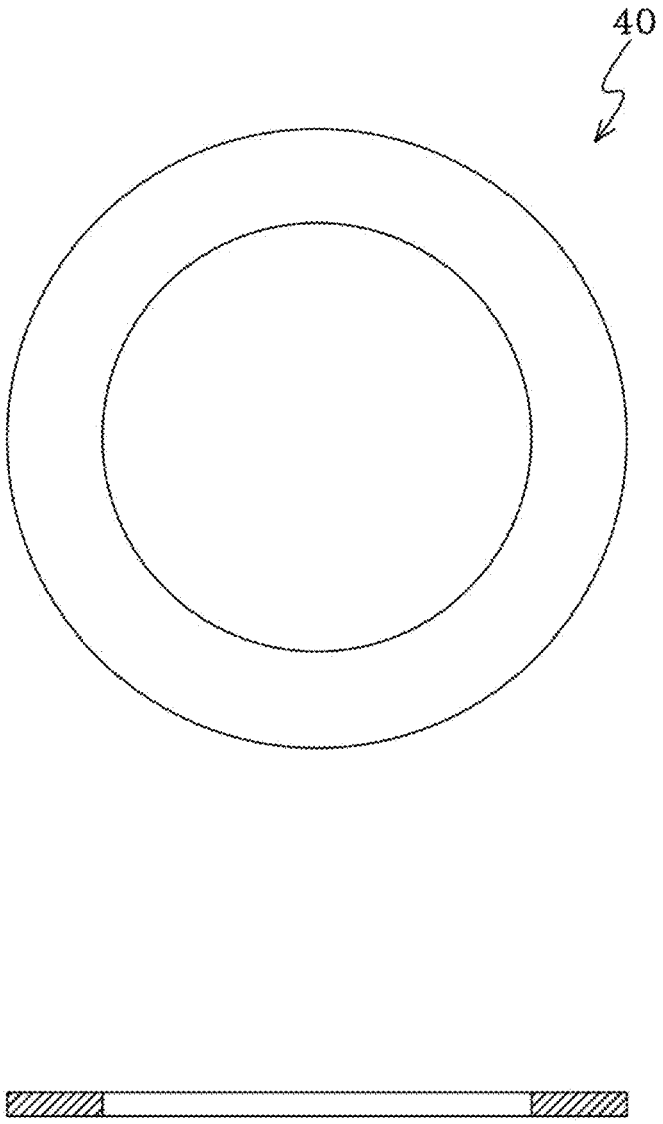
FIG. 8 is a view showing an outer mesh elastic body.
Figure 9:
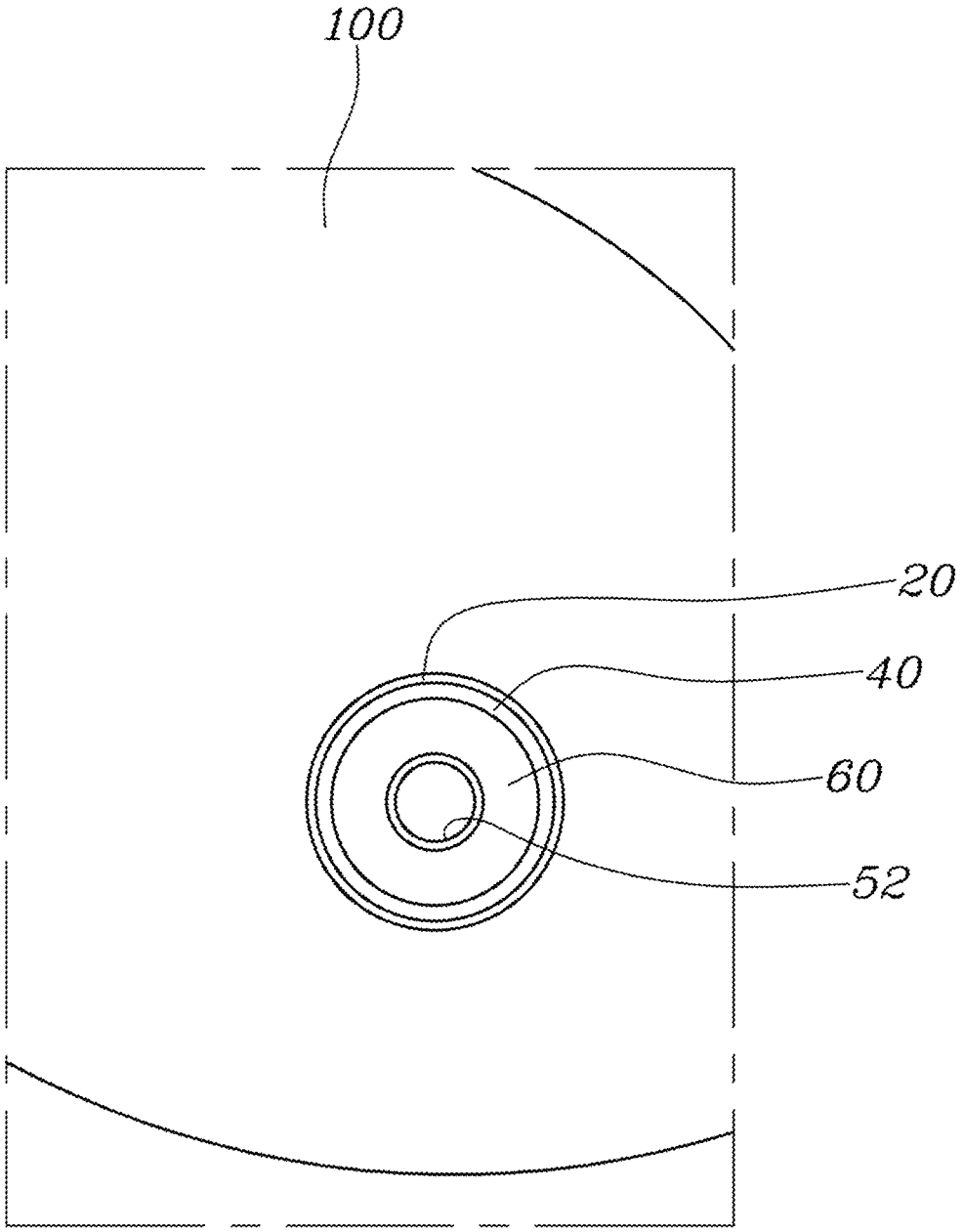
FIG. 9 is a view showing the state in which an outer bush, an outer mesh elastic body, and an outer collar are coupled to the outer side of the heat dissipation cover.
Figure 10:
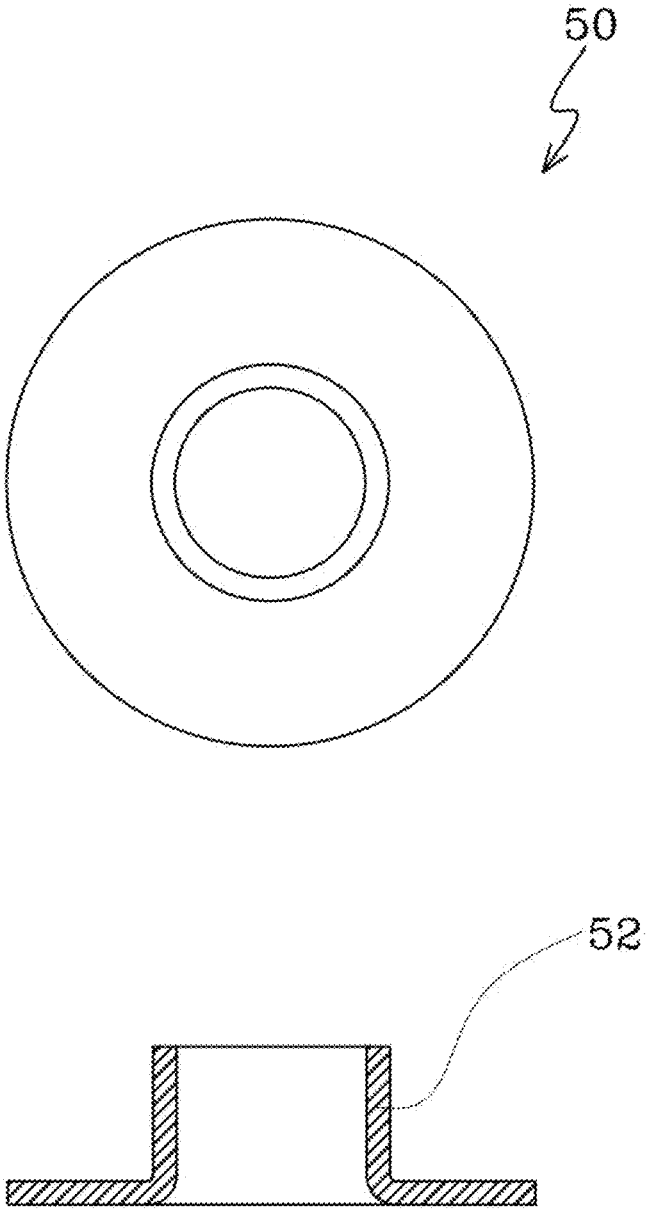
FIG. 10 is a view showing an inner collar.
Figure 11:
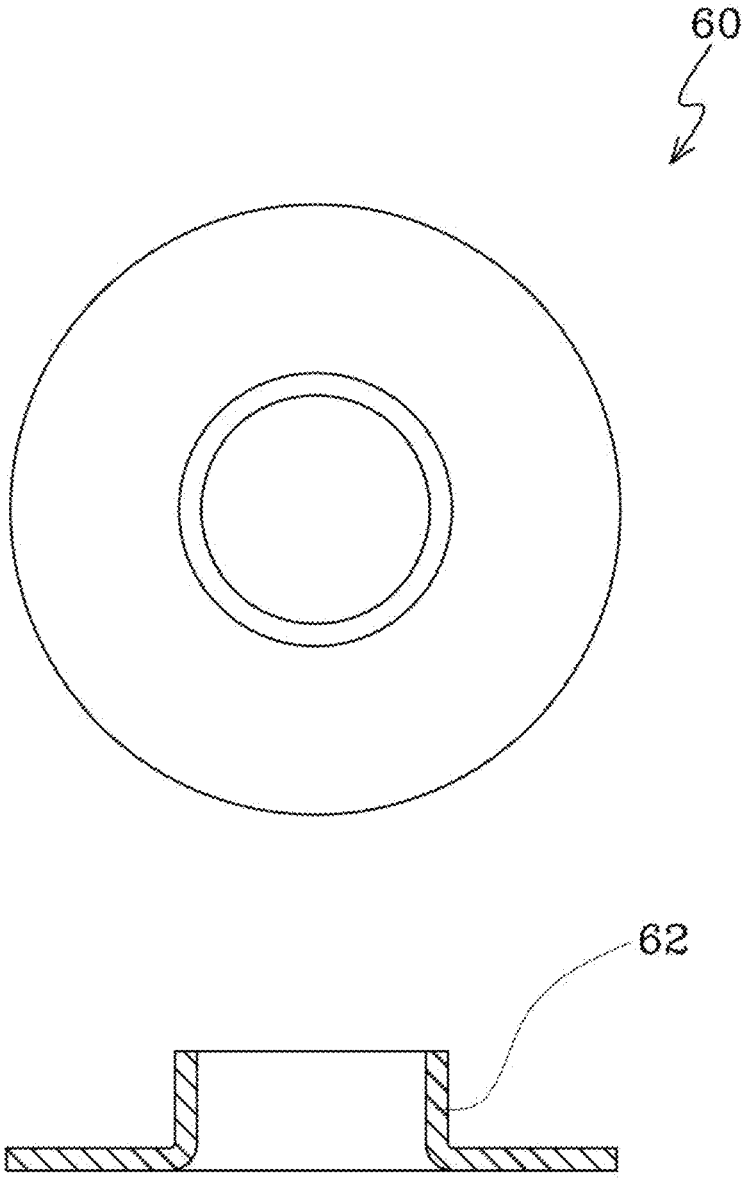
FIG. 11 is a view showing an outer collar.

FIG. 1 is a view showing a cross-section when components of an exhaust manifold heat dissipation cover coupling device for thermal stress and vibration deflection according to an embodiment of the present invention have been assembled, FIG. 2 is a view showing an inner bush, FIG. 3 is a view showing the state in which the inner bush is fitted in an outside coupling hole of a heat dissipation cover, FIG. 4 is a view showing an outer bush, FIG. 5 is a view showing the state in which the outer bush is fitted an inside coupling hole of the heat dissipation cover, FIG. 6 is a view showing an inner mesh elastic body, FIG. 7 is a view showing the state in which an inner bush, an inner mesh elastic body, and an inner collar are coupled to the inner side of the heat dissipation cover, FIG. 8 is a view showing an outer mesh elastic body, FIG. 9 is a view showing the state in which an outer bush, an outer mesh elastic body, and an outer collar are coupled to the outer side of the heat dissipation cover, FIG. 10 is a view showing an inner collar, and FIG. 11 is a view showing an outer collar.

An exhaust manifold heat dissipation cover coupling device for thermal stress and vibration deflection according to an embodiment of the present invention, referring to FIGS. 1 to 11, includes an inner bush 10, an outer bush 20, an inner mesh elastic body 30, an outer mesh elastic body 40, an inner collar 50, and an outer collar 60.

First, the exhaust manifold heat dissipation cover coupling device for thermal stress and vibration deflection according to the present invention is a device for coupling a heat dissipation cover to an exhaust manifold. The device is characterized by being able to improve the durability of parts including a heat dissipation cover by attenuating multi-directional vibration that is transmitted to the heat dissipation cover to prevent fasteners coupling the heat dissipation cover and an exhaust manifold such as bolts from being loosened by vibration transmitted from the exhaust manifold when installing the heat dissipation cover outside the exhaust manifold.

Further, the device is characterized by being able to prevent damage to various parts including a heat dissipation cover by flexibly coping with thermal deformation such as thermal expansion or thermal contraction due to thermal stress even if such thermal deformation is generated by high-temperature heat that is transmitted to the heat dissipation cover and several parts of the heat dissipation cover through fasteners such as bolts connected to an exhaust manifold.

Further, the device is characterized by being able to prevent frictional damage to a heat dissipation cover due to friction that is generated by a component elastically sliding to attenuate vibration.

Hereafter, the components of an exhaust manifold heat dissipation cover coupling device for thermal stress and vibration deflection and the functions thereof are described in detail.

Referring to FIGS. 1, 2, and 3, the inner bush 10 has a through-center portion and is coupled to the lower portion of a coupling hole 102 formed at a heat dissipation cover 100, that is, to the inner side of the heat dissipation cover 100.

Referring to FIGS. 1, 4, and 5, the outer bush 20 has a through-center portion and is coupled to the upper portion of a coupling hole 102 formed at a heat dissipation cover 100, that is, to the outer side of the heat dissipation cover 100.

Referring to FIGS. 1, 6, and 7, the inner mesh elastic body 30 has a through-center portion and is disposed in contact with the bottom of the inner bush 10.

Referring to FIGS. 1, 8, and 9, the outer mesh elastic body 40 has a through-center portion and is disposed in contact with the top of the outer bush 20.

The inner mesh elastic body 30 and the outer mesh elastic body 40 independently slide without operation together with each other in contact with the bottom of the inner bush 10 and the top of the outer bush 20, respectively, and attenuate vibration or thermal stress transmitted from an exhaust manifold to prevent fasteners connecting and fixing the exhaust manifold and the heat dissipation cover 100 from being loosened, thereby protecting the heat dissipation cover 100 such that heat dissipation cover 100 can keep firmly coupled without separating from the exhaust manifold.

Referring to FIGS. 1, 7, and 10, the inner collar 50 has a through-center portion and is disposed in contact with the bottom of the inner mesh elastic body 30.

Referring to FIGS. 1, 8, and 10, the outer collar 60 has a through-center portion and is disposed in contact with the top of the outer mesh elastic body 40.

That is, as shown in FIG. 1, the outer bush 10, outer mesh elastic body 40, and outer collar 60 are sequentially stacked over the coupling hole 102 of the heat dissipation cover 100 and the inner bush 10, inner mesh elastic body 30, and inner collar 50 are sequentially stacked under the coupling hole 102 of the heat dissipation cover 100 with the coupling hole 102 of the heat dissipation cover 100 therebetween.

The coupling hole 102 of the heat dissipation cover 100, and the through-center portions of the outer bush 20, the outer mesh elastic body 40, the outer collar 60, the inner bush 10, the inner mesh elastic body 30, and the inner collar 50 communicate with each other. A fastener such as a bolt that couples the exhaust manifold and the heat dissipation cover 100 is inserted in the communicating through-center portions.

Referring to FIG. 2, the through-center portion of the inner bush 10 forms a push protrusion 12 protruding upward, and as shown in FIG. 4, the outer bush 20 is a disc having a through-center portion.

As shown in FIGS. 3 and 5, the inner bush 10 and the outer bush 20 are coupled first to the edge of the coupling hole 102 of the heat dissipation cover 100 not to be moved, and then the inner mesh elastic body 30, the outer mesh elastic body 40, the inner collar 50, and the outer collar 60 are coupled.

Referring to FIGS. 3 and 5, when the inner bush 10 and the outer bush 20 are coupled and fixed to the coupling hole 102 of the heat dissipation cover 100, first, the inner bush 10 is placed inside the heat dissipation cover 100 and the outer bush 20 is placed outside the heat dissipation cover 100 such that the coupling hole 102 of the heat dissipation cover 100 and the through-center portions of the inner bush 10 and the outer bush 20 communicate with each other with the coupling hole 102 of the heat dissipation cover 100 therebetween.

The bush protrusion 12 of the inner bush 10, as shown in FIG. 1, is inserted through the coupling hole 102 of the heat dissipation cover 100 and the through-center portion of the outer bush 20 through the inside of the heat dissipation cover 100.

Thereafter, the bush protrusion 12 of the inner bush 10, as shown in FIG. 1, is bent outside where the outer bush 20 is disposed. Accordingly, as shown in FIG. 5, the end of the bush protrusion 12 of the inner bush 10 presses the edge of the top of the through-center portion of the outer bush 20, whereby the inner bush 10 and the outer bush 20 are coupled and fixed to the coupling hole 102 of the heat dissipation cover 100.

Referring to FIGS. 1 to 5, when the push protrusion 12 of the inner bush 10 is bent to press the edge of the center portion of the outer bush 20, an interface 16 between the end of the bent bush protrusion 12 of the inner bush 10 and the outer bush 20 is formed on the inner surface of the through-center portion of the outer bush 20 not to protrude from the top of the outer bush 20.

If the interface 16 protrudes from the top of the outer bush 20, the protruding interface forms a step when the outer mesh elastic body 40 slides on the top of the outer bush 20, which causes a problem that the outer mesh elastic body 40 cannot smoothly slide on the top of the outer bush 20.

The outer bush 20 is thinner than the inner bush 10 to prevent a step due to the thickness difference between the inner bush 10 and the outer bush 20 when the bush protrusion 12 of the inner bush 10 is bent to press the outer bush 20 such that the outer bush 20 and the inner bush 10 are coupled to the coupling hole 102 of the heat dissipation cover 100.

If the thickness of the outer bush 20 is the same as or larger than the thickness of the inner bush 10, the interface 16 may protrude from the top of the outer bush 20 or a step may be formed by the large thickness at the interface 16 when the bush protrusion 12 of the inner bush 10 is bent to be coupled to the outer bush 20, as described above. Such a step interferes with the outer mesh elastic body 40 sliding on the top of the outer bush 20, so the outer mesh elastic body 40 cannot smoothly slide.

Referring to FIGS. 1, 7, and 9, the inner bush 10 and the outer bush 20 are made of the same material as the inner mesh elastic body 30 and the outer mesh elastic body 40. The inner mesh elastic body 30 and the outer mesh elastic body 40 slide only on the contact surfaces of the inner bush 10 and the outer bush 20 not in direct contact with the heat dissipation cover 100 with the inner bush 10 and the outer bush 20 fixed to the coupling hole 102 of the heat dissipation cover 100, whereby frictional damage to the heat dissipation cover 100 is prevented.

That is, the inner mesh elastic body 30 and the outer mesh elastic body 40 that attenuate vibration while sliding by vibration generated by the exhaust manifold slide in direct contact with the inner bush 10 and the outer bush 20 made of the same material rather than in direct contact with the heat dissipation cover 100, whereby direction friction with the heat dissipation cove 100 is avoided and frictional damage is correspondingly prevented.

The inner collar 50 and the outer collar 60 couple the inner mesh elastic body 30 and the outer mesh elastic body 40 in contact with the inner bush 10 and the outer bush 20, respectively.

Referring to FIG. 10, the through-center portion of the inner collar 50 forms an inner collar protrusion 52. Referring to FIG. 11, the through-center portion of the outer collar 60 forms an outer collar protrusion 62 larger in diameter than the inner collar protrusion 52 of the inner collar 50.

Referring to FIGS. 1 and 9, the inner collar protrusion 52 of the inner collar 50 is inserted into the outer collar protrusion 62 of the outer collar 60 and then the end of the inner collar protrusion 52 is bent toward the outer collar protrusion 62, whereby the inner collar 50 and the outer collar 60 are coupled to each other.

Referring to FIGS. 1 and 6, the through-center portion of the inner mesh elastic body 30 forms a mesh protrusion 32 protruding upward. The mesh protrusion 32 is inserted in the through-center portion of the inner bush 20 and a first side gap 70 is formed between sides of the outer collar 60 and the inner mesh elastic body 30.

Referring to FIG. 1, a second side gap 80 is formed between sides of the outer mesh elastic body 40 and the inner mesh elastic body 30.

The first side gap 70 formed between sides of the outer collar 60 and the inner mesh elastic body 30 and the second side gap 80 formed between sides of the outer mesh elastic body 40 and the inner mesh elastic body 30 enable the inner mesh elastic body 30 and the outer mesh elastic body 40 to independently slide left and right. and enable the inner collar 50 and the outer collar 60 to reduce vibration and thermal stress while sliding on the contact surfaces of the inner mesh elastic body 30 and the outer mesh elastic body 40 as much as the distances of the gaps.

Referring to FIG. 1, a height gap 90 is formed between the bottom of the outer collar 60 and the tops of the outer mesh elastic body 40 and the inner mesh elastic body 30. The inner mesh elastic body 30 and the outer mesh elastic body 40 or the inner collar 50 and the outer collar 60 relatively move up and down as much as the distance of the height gap 90, thereby reducing vibration and thermal stress in the height direction.

That is, the outer mesh elastic body 40, inner mesh elastic body 30, the outer collar 60, and the inner collar 50 that are components other than the inner bush 10 and the outer bush 20 coupled and fixed to the coupling hole 102 of the heat dissipation cover 100 slide left and right or move up and down, thereby attenuate multi-directional vibration or cope with thermal deformation such as thermal contraction or thermal expansion that is generated by thermal stress transmitted from the exhaust manifold.

The above description merely explains the spirit of the present invention and the present invention may be changed, modified, and replaced in various ways without departing from the spirit of the present invention by those skilled in the art. Accordingly, the embodiments described herein and the accompanying drawings are provided merely not to limit, but to explain the spirit of the present invention, and the spirit of the present invention is not limited by the embodiments and the accompanying drawings. The protective range of the present invention should be construed by the following claims and the scope and spirit of the present invention should be construed as being included in the patent right of the present invention.

What is claimed is:

1. An exhaust manifold heat dissipation cover coupling device for thermal stress and vibration deflection, the device comprising:

an inner bush having a through-center portion and coupled to a lower portion of a coupling hole formed at a heat dissipation cover;

an outer bush having the through-center portion and coupled to an upper portion of the coupling hole formed at the heat dissipation cover;

an inner mesh elastic body having a through-center portion and disposed under the inner bush;

an outer mesh elastic body having a through-center portion and disposed over the outer bush;

an inner collar having a through-center portion and disposed under the inner mesh elastic body; and an outer collar having a through-center portion and disposed over the outer mesh elastic body, wherein the inner bush has a bush protrusion formed by the through-center portion and the outer bush is formed in a hollow disc shape, wherein the inner mesh elastic body and the outer mesh elastic body are made of the same material as the inner bush and the outer bush, the inner mesh elastic body and the outer mesh elastic body attenuate vibration and prevent wear of the heat dissipation cover by independently sliding only on contact surfaces of the inner bush and the outer bush, respectively, and wherein the outer bush is thinner than the inner bush to prevent a step due to a thickness difference between the inner bush and the outer bush when the outer bush and the inner bush are coupled to the coupling hole of the heat dissipation cover.

2. The exhaust manifold heat dissipation cover coupling device for thermal stress and vibration deflection according to claim 1, wherein the inner bush and the outer bush are first coupled and fixed to the coupling hole of the heat dissipation cover and then, the inner mesh elastic body, the outer mesh elastic body, the inner collar, and the outer collar are coupled.

3. The exhaust manifold heat dissipation cover coupling device for thermal stress and vibration deflection according to claim 1, wherein when the bush protrusion of the inner bush is bent to be coupled to the heat dissipation cover while pressing an edge of a center portion of the outer bush, an interface between the end of the bent bush protrusion of the inner bush and the outer bush is formed on an inner surface of the through-center portion of the outer bush not to protrude from a top of the outer bush.

4. The exhaust manifold heat dissipation cover coupling device for thermal stress and vibration deflection according to claim 1, wherein a first side gap is formed between sides of the outer collar and the inner mesh elastic body and a second side gap is formed between sides of the outer mesh elastic body and the inner mesh elastic body.

5. The exhaust manifold heat dissipation cover coupling device for thermal stress and vibration deflection according to claim 1, wherein a height gap is formed between a bottom of the outer collar and tops of the outer mesh elastic body and the inner mesh elastic body.

* * * * *